US010724554B2

(12) United States Patent
Thompson et al.

(10) Patent No.: US 10,724,554 B2
(45) Date of Patent: Jul. 28, 2020

(54) AUXILIARY SYSTEM FOR VEHICLE IMPLEMENTS

(71) Applicant: Parker-Hannifin Corporation, Cleveland, OH (US)

(72) Inventors: Randall D. Thompson, Lancaster, SC (US); Ralf Gomm, Foster City, CA (US); Vivek Bhaskar, Charlotte, NC (US); Björn Eriksson, Johanneshov (SE)

(73) Assignee: Parker-Hannifin Corporation, Cleveland, OH (US)

( * ) Notice: Subject to any disclaimer, the term of this patent is extended or adjusted under 35 U.S.C. 154(b) by 49 days.

(21) Appl. No.: 16/098,013

(22) PCT Filed: Apr. 25, 2017

(86) PCT No.: PCT/US2017/029327

§ 371 (c)(1),
(2) Date: Apr. 2, 2019

(87) PCT Pub. No.: WO2017/192303

PCT Pub. Date: Nov. 9, 2017

(65) Prior Publication Data

US 2019/0145433 A1 May 16, 2019

Related U.S. Application Data

(60) Provisional application No. 62/331,035, filed on May 3, 2016.

(51) Int. Cl.
*F15B 11/17* (2006.01)
*E02F 9/22* (2006.01)

(52) U.S. Cl.
CPC ..... *F15B 11/17* (2013.01); *E02F 9/2292* (2013.01); *F15B 2211/20515* (2013.01);
(Continued)

(58) Field of Classification Search
CPC ..... F15B 2211/7142; F15B 11/17; F15B 2211/20515; F15B 2211/20576; F15B 2211/88; E02F 9/2292; E02F 9/2296
See application file for complete search history.

(56) References Cited

U.S. PATENT DOCUMENTS 3,973,398 A 8/1976 Kittle
10,184,225 B2 * 1/2019 Hiraku ..... E02F 9/2242
(Continued)

FOREIGN PATENT DOCUMENTS

WO 2015196041 12/2015

OTHER PUBLICATIONS

International Search Report and Written Opinion of the International Searching Authority for corresponding International Application PCT/US2017/029327 dated Aug. 4, 2017.
(Continued)

*Primary Examiner* — Abiy Teka
(74) *Attorney, Agent, or Firm* — Renner, Otto, Boisselle & Sklar, LLP

(57) ABSTRACT

A hydraulic system includes one or more hydraulic subsystems that have a source of additional flow for supplying an auxiliary system. The hydraulic system may include one or more actuator systems, a boost system, and a further hydraulic system, such as a steering system. The source of additional flow for supplying the auxiliary system may include: sizing the boost system for providing both full boost function and auxiliary function, sizing the steering system for providing both full steering function and auxiliary function, utilizing available flow from an unused actuator function, and/or utilizing a selector manifold for actively selecting the source of auxiliary flow based on the flow and pressure demands of the respective hydraulic systems. Such a hydraulic system enables flow to be available to an auxiliary
(Continued)

function regardless of the flow requirements for the actuator functions and/or other vehicle functions, while also minimizing interactions and flow disruptions to the various hydraulic subsystems.

24 Claims, 6 Drawing Sheets

(52) U.S. Cl.
CPC ..... *F15B 2211/20523* (2013.01); *F15B 2211/20576* (2013.01); *F15B 2211/613* (2013.01); *F15B 2211/7142* (2013.01); *F15B 2211/781* (2013.01); *F15B 2211/88* (2013.01)

(56) References Cited

U.S. PATENT DOCUMENTS

2013/0098018 A1 4/2013 Knussman
2013/0312399 A1* 11/2013 Hiraku ..... F15B 15/18 60/422

OTHER PUBLICATIONS

International Preliminary Report on Patentability for corresponding International Application No. PCT/US2017/029327, dated Sep. 24, 2018.
Second Written Opinion of the International Searching Authority for corresponding International Application PCT/US2017/029327 dated May 9, 2018.

* cited by examiner

AUXILIARY SYSTEM FOR VEHICLE IMPLEMENTS

RELATED APPLICATIONS

This application is a national phase of International Application No. PCT/US2017/029327 filed Apr. 25, 2017 and published in the English language, which claims the benefit of U.S. Provisional Application No. 62/331,035 filed May 3, 2016, all of which are hereby incorporated herein by reference in their entireties.

FIELD OF INVENTION

The present invention relates generally to hydraulic systems, and more particularly to a hydraulic system having one or more hydraulic circuits as a source of flow for an auxiliary circuit.

BACKGROUND

An excavator is an example of a construction machine that uses multiple hydraulic actuators or cylinders to accomplish a variety of tasks, such as operation of a boom, an arm, a bucket, and swing. These actuators are fluidly connected to a pump that provides pressurized fluid to extend and retract the actuators for effecting movement of a work tool or tools (implements). Once the hydraulic energy is utilized, pressurized fluid flows from the actuator to a valve. The return fluid typically is at a higher pressure than the pressure in the reservoir and hence contains energy that is wasted once it crosses the valve and enters the reservoir.

To recover energy from the return fluid, the hydraulic system could utilize a servo system in which a regenerative capable electric motor would power or be powered by a fixed displacement, bi-directional pump. A regenerative capable inverter would supply power to the electric motor when the pump is required to provide power to the actuator and would consume and regenerate power to power storage from fluid being returned to either the opposing side of the actuator or to the reservoir.

In a typical unbalanced (differential) hydraulic cylinder, the cross-sectional area of a head-end or extend chamber of the cylinder is greater than the cross-sectional area of a rod-end or retract chamber. When the cylinder is extended, more fluid is needed to fill the head-end chamber of the cylinder than is being discharged from the rod-end chamber. Conversely, less fluid is needed to fill the rod-end chamber than is being discharged from the head-end chamber when the cylinder is being retracted.

A boost system may use a boost pump for supplying fluid to a fluid make-up/communication line that is in communication with inlet/outlet ports of bi-directional pump(s) that supply fluid to the cylinder, and a motor for driving the pump. The make-up/communication line selectively is in fluid communication with one of the inlet/outlet ports of the bi-directional pump when the other of the inlet/output ports is supplying pressurized fluid to the cylinder, thereby to provide hydraulic fluid at a desired inlet pressure to prevent cavitation. A steering system may also be provided with a pump for supplying fluid pressure and flow to a hydraulic circuit separate from the main task actuators.

An auxiliary system may also be provided. The auxiliary system uses hydraulic pressure and flow to turn motors or feed cylinders which operate auxiliary implements, such as brushes, snow blowers, forks, etc. On typical machines, flow and pressure for the auxiliary system may be supplied from the main hydraulic system pumps used to power the steering and/or main implement functions. However, this may cause significant loss in performance to one or more of these functions, since an auxiliary system running at high demand may siphon off too much power from the steering and/or main implement functions.

SUMMARY OF INVENTION

The present invention provides a hydraulic system including one or more hydraulic subsystems that have a source of additional flow for supplying an auxiliary hydraulic system while minimizing power loss and reducing disruptions to the respective hydraulic systems' functions. For example, the hydraulic system may include one or more actuator systems, a boost system, and/or a further hydraulic system, such as a steering system. The source of additional flow for supplying an auxiliary system may include: sizing the boost system for providing both full boost function and auxiliary function, sizing the steering system for providing both full steering function and auxiliary function, utilizing available flow from an unused actuator function, and/or utilizing a selector manifold for actively selecting the source of auxiliary flow based on the flow and pressure demands of the respective hydraulic systems. Such a hydraulic system would allow for some flow to be available to the auxiliary function regardless of the flow requirements for the actuator functions and/or other vehicle functions, while also minimizing disruptions to the various hydraulic systems.

According to one aspect of the invention, a hydraulic system for a vehicle includes at least one actuator system having a maximum flow requirement for at least one hydraulically actuated function, a boost system having a maximum flow requirement for supplying or accepting hydraulic fluid to or from the at least one actuator system, an additional system having a maximum flow requirement for an additional hydraulically actuated function, and an auxiliary system having a desired flow requirement for an auxiliary hydraulic function. The at least one of the boost system, the additional system, and the at least one actuator system may be selectively in fluid communication with the auxiliary system, and at least one of the boost system, the additional system, and the at least one actuator system includes an additional source of flow for satisfying at least a portion of the desired flow requirement of the auxiliary system.

Embodiments of the invention may include one or more of the following additional features.

In some embodiments, the at least one actuator system may include a primary hydraulic pump for satisfying the maximum flow requirement of the at least one actuator system, and at least one of the boost system and the additional system may include at least one hydraulic pump that collectively or singly satisfies the respective maximum flow requirements of the boost system, the additional system, and/or at least some of the desired flow for the auxiliary system.

In some embodiments, the at least one actuator system may include an unbalanced actuator having an extend chamber and a retract chamber to and from which hydraulic fluid is supplied and returned in opposite directions to effect operation of the hydraulically actuated function. The primary hydraulic pump may be a bi-directional pump operable in one direction for supplying hydraulic fluid through a first fluid flow line to the extend chamber of the unbalanced actuator, and operable in another direction for supplying hydraulic fluid through a second fluid flow line to the retract chamber of the unbalanced actuator. The boost system includes a boost pump for supplying hydraulic fluid to a fluid communication line selectively in fluid communication with one of the first or second fluid flow lines.

In some embodiments, the additional system may be a steering system, the steering system including a steering pump for supplying hydraulic fluid to a steering circuit to satisfy the maximum flow requirement for a hydraulically actuated steering function, and the boost system includes a boost pump for supplying hydraulic fluid to a boost circuit to satisfy the maximum flow requirement for accepting or supplying hydraulic fluid from or to the at least one actuator system.

In some embodiments, the hydraulic system also includes an electric motor for driving the primary hydraulic pump, and a single electric motor for driving both the boost pump and the steering pump.

In some embodiments, the boost system may be selectively in fluid communication with the auxiliary system, and the additional source of flow may include a boost pump that is sized to satisfy the maximum flow requirement for the boost system and additional flow for satisfying at least a portion of the desired flow requirement of the auxiliary system.

In some embodiments, the steering system may be selectively in fluid communication with the auxiliary system, and the additional source of flow may include a steering pump that is sized to satisfy the maximum flow requirement for the steering system and additional flow for satisfying at least a portion of the desired flow requirement of the auxiliary system.

In some embodiments, the boost system is in fluid communication with the steering system and the auxiliary system, wherein the boost system includes a boost pump that provides flow to the auxiliary system for satisfying at least a portion of the desired flow requirement of the auxiliary system, and wherein the steering system provides flow to the auxiliary system to supplement at least a portion of the flow provided to the auxiliary system by the boost system.

In some embodiments, the boost system supplies hydraulic fluid to the auxiliary system through an auxiliary outlet line, and hydraulic fluid is returned from the auxiliary system to the boost system through an auxiliary return line at a return pressure sufficient for providing at least a portion of the maximum flow requirement of the boost system.

In some embodiments, the boost system is in fluid communication with the steering system and the auxiliary system, wherein the boost system and the auxiliary system each have a maximum hydraulic pressure and/or flow requirement, and wherein, if the maximum hydraulic pressure and/or flow requirement of the auxiliary system is less than the maximum hydraulic pressure and/or flow requirement of the boost system, then the boost system and the steering system each supply pressure and/or flow to satisfy at least a portion of the desired pressure and/or flow requirement of the auxiliary system and the maximum pressure and/or flow requirement of the boost system.

In some embodiments, if the maximum hydraulic pressure and/or flow requirement of the auxiliary system is no less than the maximum hydraulic pressure and/or flow requirement of the boost system, then return pressure and/or flow from the auxiliary system returns to the boost system at a return pressure sufficient for providing at least a portion of the maximum flow requirement and/or maximum pressure requirement of the boost system.

In some embodiments, if the maximum hydraulic pressure and/or flow requirement of the auxiliary system is less than the maximum hydraulic pressure and/or flow requirement of the boost system, then flow from the boost pump is divided, such that at least a portion of the flow from the boost pump is provided to the auxiliary system and the remaining maximum pressure and/or flow required by the boost system is delivered through a control valve to the boost system.

In some embodiments, the at least one actuator system is selectively in fluid communication with the auxiliary system, and at least one of the boost system and the additional system is selectively in fluid communication with the auxiliary system, wherein, if an unused portion of flow from the at least one actuator system is available, then the additional source of flow for satisfying at least a portion of the desired flow requirement of the auxiliary system includes the unused portion of available flow from the at least one actuator system, and wherein, if an unused portion of flow from the at least one actuator system is unavailable, then the additional source of flow for satisfying at least a portion of the desired flow requirement for the auxiliary system includes available flow from at least one of the boost system and the additional system.

In some embodiments, if the unused portion of available flow from the at least one actuator system does not satisfy the desired flow requirement of the auxiliary system, then available flow from at least one of the boost system and the additional system supplements at least a portion of the desired flow requirement of the auxiliary system.

In some embodiments, two actuator systems are provided for respective hydraulically actuated functions, the respective actuator systems each including a hydraulic pump for satisfying the maximum flow requirements of the respective actuator systems. The respective actuator systems are selectively in fluid communication with the auxiliary system, and the additional system is selectively in fluid communication with the auxiliary system, wherein the additional source of flow includes unused portions of available flow from the respective actuator systems for satisfying at least a portion of the desired flow requirement of the auxiliary system. If unused portions of flow from the respective actuator systems is unavailable, then the additional source of flow for satisfying at least a portion of the desired flow requirement for the auxiliary system includes available flow from the additional system.

In some embodiments, the additional system is a steering system having a steering pump for supplying hydraulic fluid to a steering circuit to satisfy the maximum flow requirement for a hydraulically actuated steering function. If the unused portions of available flow from the respective actuator systems does not satisfy the desired flow requirement of the auxiliary system, then available flow from the steering system supplements at least a portion of the desired flow requirement of the auxiliary system.

In some embodiments, the at least one actuator system includes a hydraulic pump for satisfying the maximum flow requirement of the at least one actuator system, wherein the at least one actuator system is selectively in fluid communication with the auxiliary system, and at least one of the boost system and the additional system is selectively in fluid communication with the auxiliary system. If the at least one actuator system does not demand flow for effecting the hydraulically actuated function, then the additional source of flow for satisfying at least a portion of the desired flow requirement of the auxiliary system includes flow from the at least one actuator system that does not demand flow. If the at least one actuator system demands flow for effecting the hydraulically actuated function, then the at least one actuator system demanding flow is selectively closed from supplying flow to the auxiliary system, and the additional source of flow for satisfying at least a portion of the desired flow requirement of the auxiliary system includes available flow from at least one of the boost system and the additional system.

In some embodiments, at least two actuator systems are provided for respective hydraulically actuated functions, the respective actuator systems each including a hydraulic pump for satisfying the maximum flow requirements of the respective actuator systems, wherein the respective actuator systems are selectively in fluid communication with the auxiliary system, and at least one of the boost system and the additional system is selectively in fluid communication with the auxiliary system. If at least one of the respective actuator systems does not demand flow for effecting the hydraulically actuated function, then the additional source of flow for satisfying at least a portion of the desired flow requirement of the auxiliary system includes flow from the at least one actuator system that does not demand flow. If at least one of the respective actuator systems demands flow for effecting the hydraulically actuated function, then the at least one actuator system demanding flow is selectively closed from supplying flow to the auxiliary system, and the additional source of flow for satisfying at least a portion of the desired flow requirement of the auxiliary system includes available flow from at least one of the boost system, the additional system, and another actuator system that does not demand flow.

In some embodiments, the additional system is a steering system having a steering pump for supplying hydraulic fluid to a steering circuit to satisfy the maximum flow requirement for a hydraulically actuated steering function; and, if the available flow from the at least one actuator system that supplies flow to the auxiliary system does not satisfy the desired flow requirement of the auxiliary system, then available flow from at least one of the steering system and the boost system supplements at least a portion of the desired flow requirement of the auxiliary system.

According to another aspect of the invention, a hydraulic system for a vehicle includes a first hydraulic circuit for a first function, a boost pump for supplying hydraulic fluid to a boost circuit in fluid communication with the first hydraulic circuit, and an auxiliary circuit having a desired flow requirement for an auxiliary function, wherein the boost circuit is in fluid communication with the auxiliary circuit and the boost pump supplies flow to the auxiliary circuit to satisfy at least a portion of the desired flow requirement of the auxiliary circuit.

Embodiments of the invention may include one or more of the following additional features.

For example, in some embodiments, the boost circuit has a maximum flow requirement for supplying or accepting hydraulic fluid to or from the first hydraulic circuit, and the boost pump is sized to satisfy the maximum flow requirement for the boost circuit and to provide additional flow for satisfying at least a portion of the desired flow requirement of the auxiliary circuit.

In some embodiments, the first hydraulic circuit includes an unbalanced actuator having an extend chamber and a retract chamber to and from which hydraulic fluid is supplied and returned in opposite directions to effect operation of the first function, and a bi-directional pump operable in one direction for supplying hydraulic fluid through a first fluid flow line to the extend chamber of the unbalanced actuator, and operable in another direction for supplying hydraulic fluid through a second fluid flow line to the retract chamber of the unbalanced actuator, wherein the boost bump is connected to a fluid communication line selectively in fluid communication with one of the first or second fluid flow lines of the first hydraulic circuit.

In some embodiments, the boost circuit includes a boost manifold in fluid communication with the first hydraulic circuit and the auxiliary circuit, and the boost manifold includes a pressure reducing valve and an auxiliary flow priority valve controlled by a pilot valve.

In some embodiments, the auxiliary flow priority valve is configured to control the hydraulic fluid pressure supplied to the auxiliary circuit, while allowing sufficient flow to be supplied to the boost circuit through the pressure reducing valve, which is configured to reduce the pressure from the auxiliary circuit to a level about equal to the pressure requirement of the boost circuit.

In some embodiments, if the auxiliary flow demand is minimal, such as near zero, and if the boost flow demand is near maximum, then the auxiliary flow priority valve is configured to allow up to the maximum boost flow to pass through the auxiliary flow priority valve to the pressure reducing valve, where the pressure from the auxiliary circuit is reduced to a level equal to the pressure requirement of the boost circuit.

According to another aspect of the invention, a hydraulic system for a vehicle includes a first hydraulic circuit for a first function, a boost circuit for supplying or accepting hydraulic fluid to or from the first hydraulic circuit, an additional hydraulic pump for supplying hydraulic fluid to an additional hydraulic circuit having a maximum flow requirement for effecting an additional function, and an auxiliary circuit having a desired flow requirement for an auxiliary function, wherein the additional hydraulic circuit is selectively in fluid communication with the auxiliary circuit, and wherein the additional hydraulic pump is sized to satisfy the maximum flow requirement for the additional hydraulic circuit and to provide additional flow for satisfying at least a portion of the desired flow requirement of the auxiliary circuit.

Embodiments of the invention may include one or more of the following additional features.

For example, in some embodiments, the first hydraulic circuit includes an unbalanced actuator having an extend chamber and a retract chamber to and from which hydraulic fluid is supplied and returned in opposite directions to effect operation of the first function, and a bi-directional pump operable in one direction for supplying hydraulic fluid through a first fluid flow line to the extend chamber of the unbalanced actuator, and operable in another direction for supplying hydraulic fluid through a second fluid flow line to the retract chamber of the unbalanced actuator, wherein the additional circuit is a steering circuit and the additional hydraulic pump is a steering pump, the steering pump for supplying hydraulic fluid to the steering circuit for a hydraulically actuated steering function, and wherein the boost system includes a boost pump for supplying hydraulic fluid to a boost circuit connected to a fluid communication line selectively in fluid communication with one of the first or second fluid flow lines of the first hydraulic circuit.

In some embodiments, the boost circuit is selectively in fluid communication with the auxiliary circuit, wherein the boost circuit includes an additional source of flow for satisfying at least a portion of the desired flow requirement of the auxiliary system, and wherein the boost circuit supplements at least a portion of the desired flow requirement of the auxiliary system.

In some embodiments, the additional source of flow from the boost circuit includes an unused portion of flow from the boost circuit.

In some embodiments, the additional circuit is a steering circuit and the additional hydraulic pump is a steering pump, the steering pump for supplying hydraulic fluid to the steering circuit for a hydraulically actuated steering function. The boost circuit is in fluid communication with the steering circuit and the auxiliary circuit, and the boost circuit includes a boost pump that provides flow to the auxiliary circuit for satisfying at least a portion of the desired flow requirement of the auxiliary circuit. The steering circuit provides flow to the auxiliary circuit to supplement at least a portion of the flow provided to the auxiliary circuit by the boost circuit.

In some embodiments, the boost circuit supplies hydraulic fluid to the auxiliary circuit through an auxiliary outlet line, and hydraulic fluid is returned from the auxiliary circuit to the boost circuit through an auxiliary return line at a return pressure sufficient for providing at least a portion of the maximum flow requirement of the boost circuit.

In some embodiments, the boost circuit is in fluid communication with the steering circuit and the auxiliary circuit, wherein the boost circuit and the auxiliary circuit each have a maximum hydraulic pressure and/or flow requirement. If the maximum hydraulic pressure and/or flow requirement of the auxiliary circuit is less than the maximum hydraulic pressure and/or flow requirement of the boost circuit, then the boost circuit and the steering circuit each supply pressure and/or flow to satisfy at least a portion of the desired pressure and/or flow requirement of the auxiliary circuit and the maximum pressure and/or flow requirement of the boost circuit.

In some embodiments, if the maximum hydraulic pressure and/or flow requirement of the auxiliary circuit is no less than the maximum hydraulic pressure and/or flow requirement of the boost circuit, then return pressure and/or flow from the auxiliary circuit returns to the boost circuit at a return pressure sufficient for providing at least a portion of the maximum desired flow requirement and/or maximum pressure requirement of the boost circuit.

In some embodiments, if the maximum hydraulic pressure and/or flow requirement of the auxiliary circuit is less than the maximum hydraulic pressure and/or flow requirement of the boost circuit, then flow from the boost pump is divided between the auxiliary circuit and the boost circuit through a control valve.

In some embodiments, the boost circuit includes a boost manifold in fluid communication with the first hydraulic circuit and the auxiliary circuit, and the control valve that reduces the boost supply pressure is configured as an auxiliary flow priority valve controlled by a pilot valve, where the respective valves are included in the boost manifold.

According to another aspect of the invention, a hydraulic system for a vehicle includes a first primary hydraulic circuit having a required flow for use in effecting a first primary function, a boost circuit for supplying or accepting hydraulic fluid to or from the first primary hydraulic circuit, an additional hydraulic circuit for an additional function, and an auxiliary circuit having a desired flow requirement for an auxiliary function, wherein the first primary hydraulic circuit and at least one of the boost circuit and the additional hydraulic circuit are selectively in fluid communication with the auxiliary circuit. If an unused portion of flow from the first primary hydraulic circuit is available, the first primary hydraulic circuit supplies flow to the auxiliary circuit to satisfy at least a portion of the desired flow requirement of the auxiliary circuit. If an unused portion of flow from the first primary circuit is unavailable, then flow from at least one of the boost circuit and the additional hydraulic circuit supplies flow to the auxiliary circuit to satisfy at least a portion of the desired flow requirement of the auxiliary circuit.

Embodiments of the invention may include one or more of the following additional features.

For example, in some embodiments, if the unused portion of available flow from the first primary hydraulic circuit does not satisfy the desired flow requirement of the auxiliary circuit, then available flow from at least one of the boost circuit and the additional circuit supplements at least a portion of the desired flow requirement of the auxiliary circuit.

In some embodiments, the first primary hydraulic circuit includes an unbalanced actuator having an extend chamber and a retract chamber to and from which hydraulic fluid is supplied and returned in opposite directions to effect operation of the first primary function, and a bi-directional pump operable in one direction for supplying hydraulic fluid through a first fluid flow line to the extend chamber of the unbalanced actuator, and operable in the other direction for supplying hydraulic fluid through a second fluid flow line to the retract chamber of the unbalanced actuator. The additional circuit is a steering circuit and the additional hydraulic pump is a steering pump, the steering pump for supplying hydraulic fluid to the steering circuit for a hydraulically actuated steering function. The boost circuit includes a boost pump for supplying hydraulic fluid to the boost circuit connected to a fluid communication line selectively in fluid communication with one of the first or second fluid flow lines of the first primary hydraulic circuit.

In some embodiments, the primary hydraulic circuit may be an actuator circuit. One or more primary hydraulic circuits may be provided, including a first primary hydraulic circuit, such as a first actuator circuit, and a second primary hydraulic circuit, such as a second actuator circuit. In other embodiments, the primary hydraulic circuit may be a steering circuit, or a hydraulic circuit for some other main function.

In some embodiments, the hydraulic system further includes a second primary hydraulic circuit including an unbalanced actuator having an extend chamber and a retract chamber to and from which hydraulic fluid is supplied and returned in opposite directions to effect operation of the first function, and a bi-directional pump operable in one direction for supplying hydraulic fluid through a first fluid flow line to the extend chamber of the unbalanced actuator, and operable in the other direction for supplying hydraulic fluid through a second fluid flow line to the retract chamber of the unbalanced actuator. The boost circuit may be selectively in fluid communication with one of the first or second fluid flow lines of the second primary hydraulic circuit. If unused portions of flow from at least one of the first primary hydraulic circuit and the second primary hydraulic circuit is available, then at least one of the first primary hydraulic circuit and the second primary hydraulic circuit supplies flow to the auxiliary circuit to satisfy at least a portion of the desired flow requirement of the auxiliary circuit. If unused portions of flow from at least one of the first primary hydraulic circuit and the second primary hydraulic circuit is unavailable, then available flow from the steering circuit supplies flow to the auxiliary circuit to satisfy at least a portion of the desired flow requirement of the auxiliary circuit.

In some embodiments, if the unused portions of available flow from the respective primary hydraulic circuits does not satisfy the desired flow requirement of the auxiliary circuit, then available flow from the steering circuit supplements at least a portion of the desired flow requirement of the auxiliary circuit.

In some embodiments, the hydraulic system further includes a select manifold in fluid communication with the first primary hydraulic circuit, in fluid communication with the additional hydraulic circuit, and in fluid communication with the auxiliary circuit, and the select manifold includes a selector valve operated by an electrically controlled pilot valve, the selector valve being configured to selectively allow flow to be supplied from the first primary hydraulic circuit to the auxiliary circuit based on the first primary hydraulic circuit flow demands.

In some embodiments, the hydraulic system further includes a second primary hydraulic circuit including an unbalanced actuator having an extend chamber and a retract chamber to and from which hydraulic fluid is supplied and returned in opposite directions to effect operation of the first function, and a bi-directional pump operable in one direction for supplying hydraulic fluid through a first fluid flow line to the extend chamber of the unbalanced actuator, and operable in another direction for supplying hydraulic fluid through a second fluid flow line to the retract chamber of the unbalanced actuator; wherein the boost circuit is selectively in fluid communication with one of the first or second fluid flow lines of the second primary hydraulic circuit. If at least one of the first primary hydraulic circuit and the second primary hydraulic circuit does not demand flow for effecting a hydraulically actuated function, then flow for satisfying at least a portion of the desired flow requirement of the auxiliary circuit includes flow from the primary hydraulic circuit that does not demand flow. If at least one of the first primary hydraulic circuit and the second primary hydraulic circuit demands flow for effecting a hydraulically actuated function, then the primary hydraulic circuit demanding flow is selectively closed from supplying flow to the auxiliary circuit, and the source of flow for satisfying at least a portion of the desired flow requirement of the auxiliary circuit includes available flow from at least one of the boost circuit and the additional circuit.

In some embodiments, if the flow from the primary hydraulic circuit that supplies flow to the auxiliary circuit does not satisfy the desired flow requirement of the auxiliary circuit, then available flow from at least one of the steering circuit and the boost circuit supplements at least a portion of the desired flow requirement of the auxiliary circuit.

In some embodiments, the hydraulic system further includes a select manifold in fluid communication with the first primary hydraulic circuit and the second primary hydraulic circuit, in fluid communication with the additional hydraulic circuit, and in fluid communication with the auxiliary circuit; wherein the select manifold includes selector valves operated by respective electrically controlled pilot valves, the respective selector valves being configured to selectively allow flow to be supplied from the respective primary hydraulic circuits, for example respective actuator circuits, to the auxiliary circuit based on the respective primary hydraulic circuits flow demands.

To the accomplishment of the foregoing and related ends, aspects of the invention comprise the features hereinafter fully described and particularly pointed out in the claims. The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

The principles of the present invention relate generally to regenerative hydraulic systems having closed-loop hydraulic pump-motors in fluid communication with electro-hydraulic actuation (EHA) systems and vehicle subsystems, such as boost, steering, and auxiliary implement systems. The hydraulic actuation system may be used for extending and retracting at least one unbalanced hydraulic cylinder in a work machine, such as hydraulic excavators, wheel loaders, loading shovels, backhoe shovels, mining equipment, industrial machinery and the like, having one or more hydraulically actuated components such as lifting and/or tilting arms, booms, buckets, steering and turning functions, traveling means, etc. The principles of the present invention have particular application to supplying flow from one or more of the hydraulic subsystems to one or more auxiliary systems in the work machine's hydraulic system, and thus will be described below chiefly in this context. It will of course be appreciated, and also understood, that principles of this invention may also be applicable to other non-vehicle, non-EHA hydraulic systems.

Figure 1:
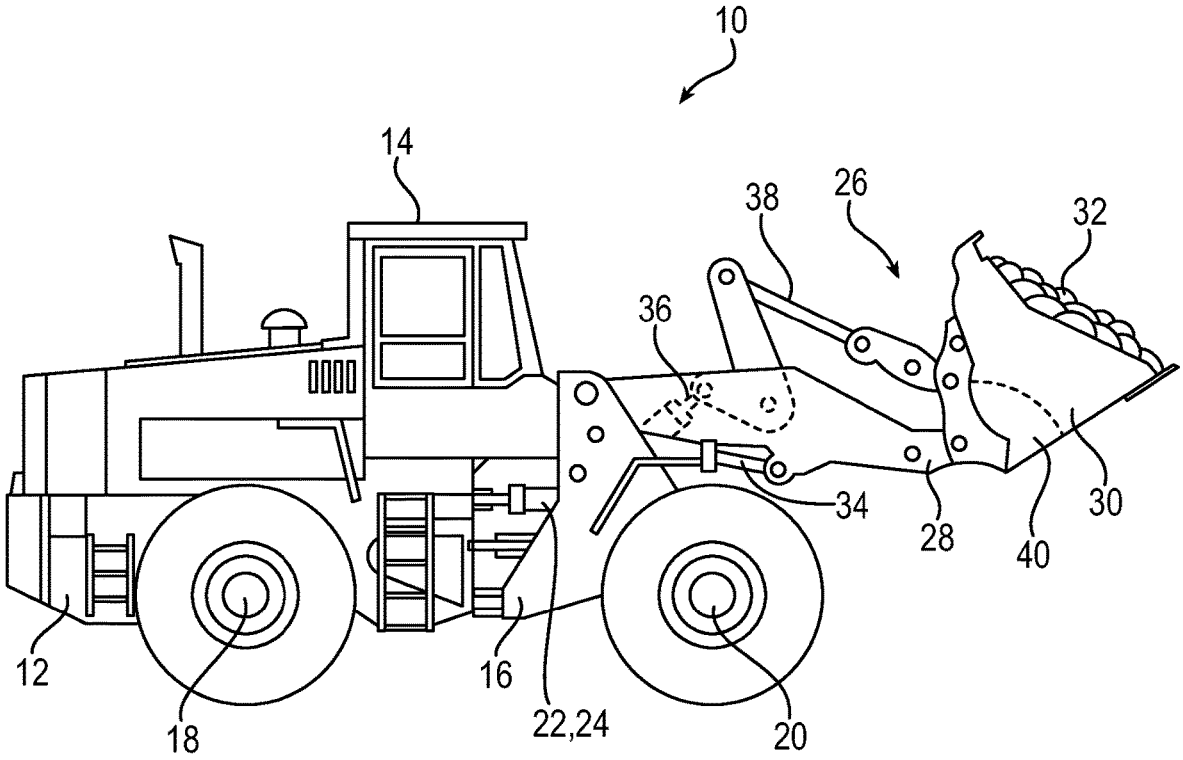
FIG. 1 is a side view of an exemplary work machine.

Referring to the drawings, and initially to FIG. 1, an exemplary wheel loader is illustrated generally at reference numeral 10. The wheel loader 10 comprises a rear vehicle part 12 including a cab/compartment 14 and a front vehicle part 16, which parts each comprise a frame and respective drive axles 18 and 20. The vehicle parts 12 and 16 are coupled together with one another in such a way that they can be pivoted relative to one another about a vertical axis by means of hydraulic cylinders 22, 24 which are connected to the two parts on opposite sides of the wheel loader. The hydraulic cylinders 22, 24 provide for steering, or turning, the wheel loader.

The wheel loader 10 further comprises an apparatus 26 for handling objects or material. The apparatus 26 comprises a lifting arm unit 28 and an implement 30 in the form of a bucket which is mounted on the lifting arm unit. The bucket 30 is shown filled with material 32. One end of the lifting arm unit 28 is coupled rotatably to the front vehicle part 16 for bringing about a lifting movement of the bucket. The bucket is coupled rotatably to an opposite end of the lifting arm unit for bringing about a tilting movement of the bucket.

The lifting arm unit 28 can be raised and lowered in relation to the front part 16 of the vehicle 10 by means of two hydraulic cylinders 34 on opposite sides of the lifting arm unit. The hydraulic cylinders 34 are each coupled at one end to the front vehicle part 16 and at the other end to the lifting arm unit 28. The bucket 30 can be tilted in relation to the lifting arm unit 28 by means of a third hydraulic cylinder 36, which is coupled at one end to the front vehicle part and at the other end to the bucket via a link arm system 38.

The wheel loader 10 may also include an auxiliary implement 40, such as an auger or snow blower for dispensing the material 32. The auxiliary implement 40 may be operated by hydraulically powered motors or cylinders that are supplied with flow from an auxiliary circuit. The auxiliary implement may be coupled to the lifting arm 28, or may be connected to other parts of the wheel loader 10, such as the rear vehicle part 12, via auxiliary outlet ports and other linkages.

The wheel loader 10 is shown and described to facilitate an understanding of the invention and not by way of limitation. As will be appreciated, the wheel loader is just one example of a work machine that may benefit from the present invention. Other types of work machines (including work vehicles) include, without limitation, excavator loaders (backhoes), excavating machines, mining equipment, and industrial applications and the like having multiple actuation functions, such as lifting arms, booms, buckets, steering and/or turning functions, and traveling means, as well as various other auxiliary functions.

Figure 2:
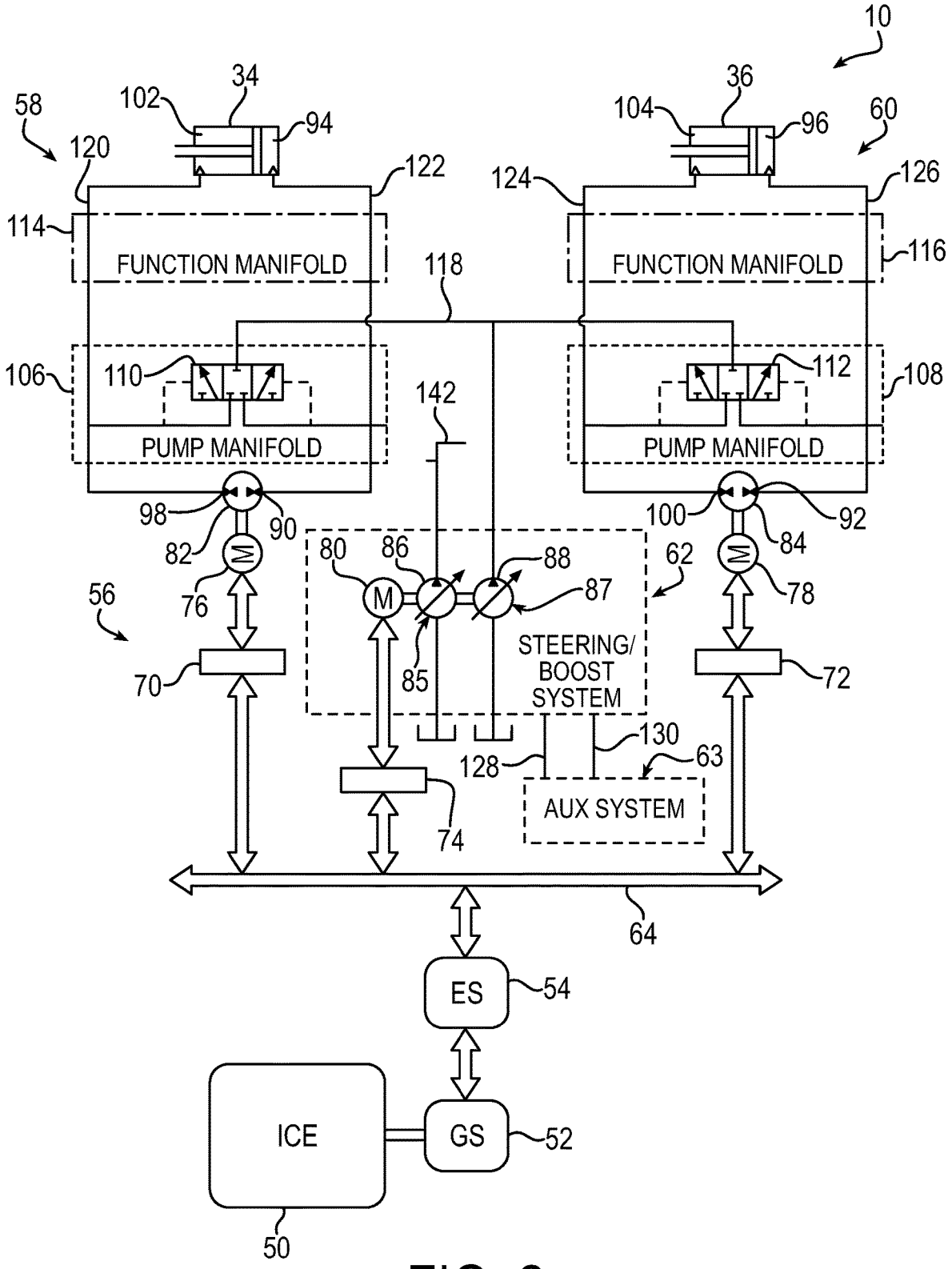
FIG. 2 is a schematic illustration of an exemplary hydraulic system according to the invention.

Turning now to FIG. 2, a hybrid wheel loader 10 includes a prime mover 50, such as an internal combustion engine, a generator set 52 mechanically connected to the prime mover 50, an electrical storage device 54, and a hydraulic system 56. The prime mover 50 is sized to operate at an optimum speed and provides shaft power to the generator set 52 which, in turn, charges the electrical storage device 54 and provides electrical power to a voltage bus 64, such as a direct current (DC) voltage bus. The voltage bus 64 feeds a separate drive (not shown) for the machine's traction system, and also provides power to regenerative drives 70, 72, 74, such as inverters.

The hydraulic system 56 may be a hybrid electro-hydraulic system that may comprise one or more actuator systems having a maximum flow requirement for extending and retracting respective unbalanced hydraulic cylinders. By way of example and not limitation, the hydraulic system 56 has two such actuator systems 58 and 60 that may be used to control respective hydraulically actuated functions, such as the lift and tilt cylinders 34 and 36 of the wheel loader 10. The hydraulic system 56 also has a steering/boost system 62 having a maximum flow requirement for steering the wheels/tracks of the loader 10 and/or for providing flow to a flow related circuit, such as providing make-up fluid for boost to the actuator systems 58 and 60. The hydraulic system 56 also includes an auxiliary system 63 having a desired flow requirement for supplying fluid to motors or feed cylinders that operate auxiliary implements, such as brushes, snow blowers, forks, augers, mixers, tillers, compactors, and the like.

The hydraulic subsystems 58, 60, and 62 include the respective regenerative drives 70, 72, 74, the respective electric motors 76, 78, 80, and at least one hydraulic pump 82, 84, 86 mechanically connected to the respective electric motors 76, 78, 80. The regenerative drives 70, 72, and 74 provide power to and consume power from the respective electric motors 76, 78, and 80. The electric motors 76 and 78 provide shaft power to or consume and regenerate shaft power from the respective hydraulic pump 82 and 84, which may be fixed displacement, bi-directional pumps.

The hydraulic pumps 82 and 84 supply flow to satisfy the flow requirements of the respective cylinders 34 and 36. The hydraulic pumps 82 and 84 are operable in one direction for supplying pressurized fluid from one inlet/outlet port 90, 92 through a first fluid flow line to a head-end chamber 94, 96 of the respective cylinders 34, 36 for operating the cylinder in one direction, and operable in a second direction opposite the first direction for supplying pressurized fluid from another inlet/outlet port 98, 100 through a second fluid flow line to a rod-end chamber 102, 104 of the respective cylinders 34, 36 for operating the cylinder in a direction opposite the first direction. The hydraulic pumps 82 and 84 are connected to the respective cylinders 34, 36 through respective pump manifolds 106 and 108, which house respective control valves 110 and 112, and are also connected through respective function manifolds 114 and 116 that each house one or more valves (not shown) for controlling cylinder speed during hydraulic regeneration or pressure dump and for load holding. The manifolds 106, 108, 114 and 116 may also house pressure relief valves (not shown) that protect the pumps 82, 84 and cylinders 34, 36 from over pressurization. Check valves (not shown) may also be provided in parallel with the relief valves in the circuit between the pump and respective load holding valves (not shown) to prevent the possibility of cavitation from occurring.

The control valves 110 and 112, which may be pilot-operated, three position shuttle valves, provide for the connection of the chambers 94, 102 and 96, 104, respectively, to a fluid communication line 118. The control valve 110 is operated by differential pressure between the lines 120 and 122 to connect line 122 to the communication line 118 when pressure in the line 120 exceeds the pressure in the line 122 by a prescribed amount whereby make-up fluid can be supplied through the communication line to line 122, and to connect the line 120 to the communication line 118 when pressure in the line 122 exceeds the pressure in the line 120 by a prescribed amount, whereby excess fluid from the head-end chamber 94 of the hydraulic cylinder 34 can be accepted by the communication line 118. Similarly, the control valve 112 is operated by differential pressure between the lines 124 and 126 to connect line 126 to the communication line 118 when pressure in the line 124 exceeds the pressure in the line 126 by a prescribed amount whereby make-up fluid can be supplied through the communication line 118 to line 126, and to connect the line 124 to the communication line 118 when pressure in the line 126 exceeds the pressure in the line 124 by a prescribed amount, whereby excess fluid from the head-end chamber 96 of the hydraulic cylinder 34 can be accepted by the communication line 118.

Figure 3:
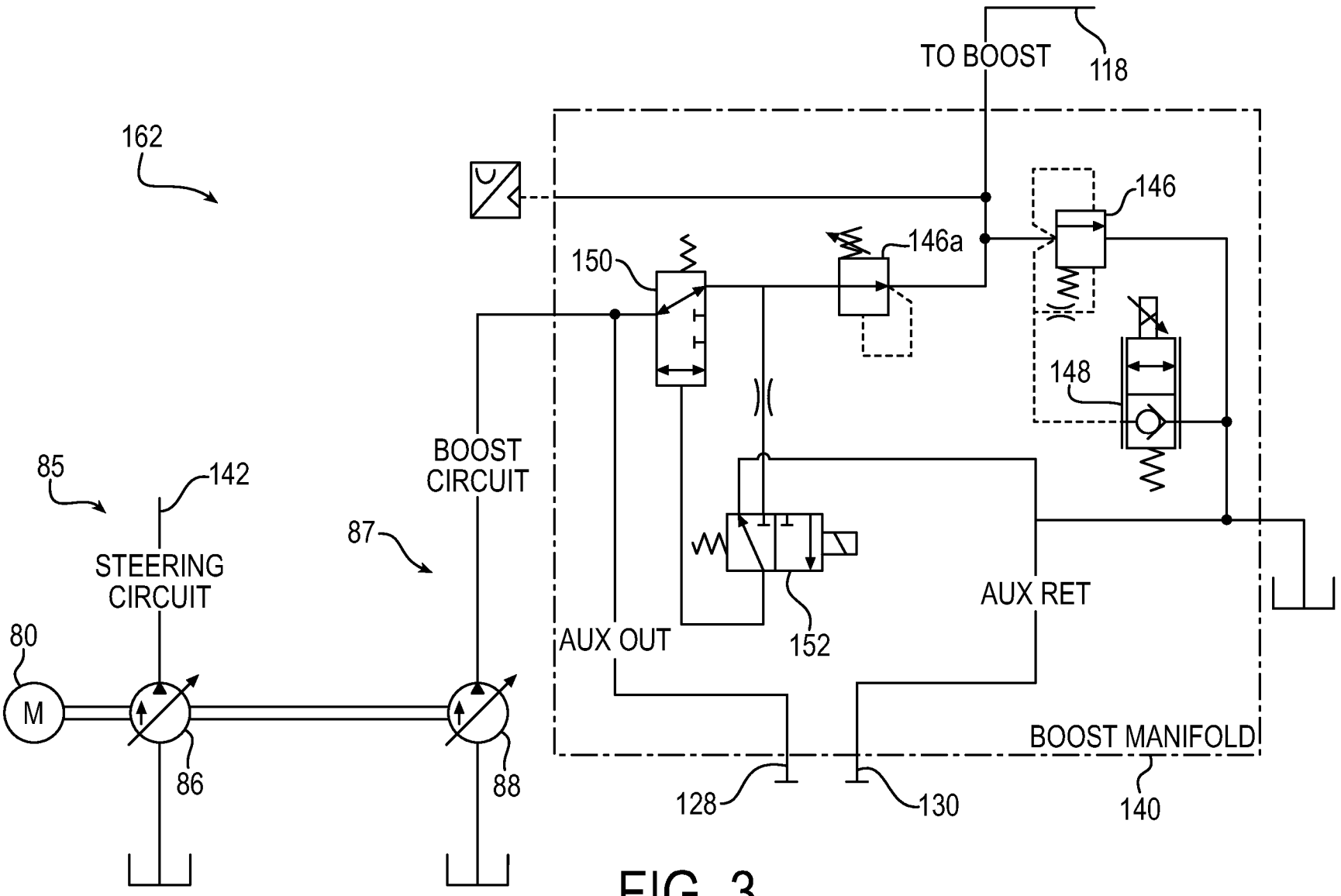
FIG. 3 is a schematic illustration of another exemplary hydraulic system according to the invention.

Referring now to the steering/boost system 62 in detail, the system 62 includes the regenerative drive 74, the electric motor 80, the at least one hydraulic pump 86, and an optional manifold (shown in FIG. 3). The hydraulic pump 86 (also referred to as the second hydraulic pump 86, or the additional hydraulic pump 86) collectively or singly supplies hydraulic fluid to one or more additional hydraulic circuits (not shown), such as for steering or other additional function, and also supplies hydraulic fluid to a boost circuit that is connected to a fluid communication line 118 that is selectively in fluid communication with one of the inlet/outlet ports 90 and 98 via valve 110 and with one of the inlet/outlet ports 92 and 100 via valve 112 for boost or make-up flow. The boost flow supplements pump flow in the extend direction to prevent fluid from dropping below a cavitation pressure that would damage the pump, and the system 62 manages excess flow in the retract direction. The boost system and method of providing boost flow may be the same as or substantially similar to the boost system described in International Application No. PCT/US2009/33720, filed Feb. 11, 2009, incorporated herein by reference in its entirety.

The steering/boost system 62 may be a combined steering/boost system having a single electric motor 80, such as the combined steering/boost system described in U.S. Provisional Application No. 62/014,399, filed Jun. 19, 2014, which is incorporated herein by reference in its entirety. However, the steering/boost system 62 may have a boost system 87 separate from a steering system 85, with the respective systems 85 and 87 having respective hydraulic circuits, hydraulic pumps, and electric motors. In addition, although the steering/boost system 62 has been described as providing fluid for both steering and boost, it will be appreciated that the hydraulic subsystem 62 may be used to produce the flow requirements for two pressure related circuits, two flow related circuits, or a pressure related and a flow related circuit for any suitable operation. For example, although referred to in the various embodiments as the steering system 85 using the steering pump 86, it should be understood that the hydraulic pump 86 could be a second or additional hydraulic pump 86 used to supply hydraulic fluid to one or more secondary or additional hydraulic circuits for other functions.

In the illustrated embodiment, the steering/boost system 62 includes the steering pump 86 for supplying hydraulic fluid to a steering circuit via line 142 to satisfy the maximum flow requirement for a hydraulically actuated steering function. The steering/boost system 62 also includes a hydraulic boost pump 88 that supplies hydraulic fluid to a boost circuit fluidly connected to the fluid communication line 118 for satisfying the maximum boost flow for supplying hydraulic fluid to, or accepting hydraulic fluid from, the actuator system 58 and/or 60. When boost is demanded by the pumps 82 and 84, fluid is pumped by the boost pump 88 to the manifold, wherein the fluid may flow through suitable flow controls to the communication line 118, which then supplies the fluid to the valves 110 and 112. The steering pump 86 and boost pump 88 may be variable displacement pumps mechanically connected to and driven by at least one electric motor 80, such as a single electric motor 80. The steering/boost system 62 may be operated in constant speed mode for steering demands, or variable speed mode when steering demands are below boost demands.

In the exemplary hydraulic system 56 shown in FIG. 2, the auxiliary system 63 is selectively in fluid communication with the steering/boost system 62 via an auxiliary outlet line 128 for supplying a desired flow to the auxiliary system 63 to effect an auxiliary function, and an auxiliary return line 130 for return flow to the steering/boost system 62. As will be described in further detail below, the auxiliary system 63 may also be selectively in fluid communication with one or more of the actuator systems 58 and 60 for supplying flow to the auxiliary system 63.

So as to minimize power loss and reduce flow disruptions to the respective hydraulic subsystems e.g., 58, 60, and/or 62 that supply flow to the auxiliary system 63, one or more of the hydraulic subsystems e.g., 58, 60, and 62 may include an additional source of flow for satisfying at least a portion of the desired flow requirement of the auxiliary system 63. For example, as will be described in the various exemplary and non-limiting embodiments below, the source of additional flow for supplying the auxiliary system 63 may include the boost system 87, such as the boost pump 88, being sized to satisfy the maximum flow requirement of the boost system 87 (i.e., provide full boost function) and provide additional flow for satisfying at least a portion of the desired flow requirement of the auxiliary system 63. Alternatively or additionally, the steering system 85, such as the steering pump 86, may be sized to satisfy the maximum flow requirement of the steering system 85 (i.e., provide full steering function) and provide additional flow for satisfying at least a portion of the desired flow requirement of the auxiliary system 63. The source of additional flow may also include available flow from one or more of the actuator systems 58 and 60, which may be selected based on the flow and pressure demands of the respective actuator systems 58 and 60, as will be described in further detail below. To facilitate selection of the source of flow for the auxiliary system 63, a boost manifold and/or selector manifold having respective control valves may be used with one or more of the hydraulic subsystems e.g., 58, 60, and 62. In addition, the hydraulic system 56 may include controllers, such as processors and/or flow control devices, to control the additional source of flow for satisfying at least a portion of the desired flow requirement of the auxiliary system 63.

Turning now to FIG. 3, an exemplary embodiment of a portion of the hydraulic system 56 including a steering/boost system 162 is shown in fluid communication with the auxiliary system (e.g., 63 shown in FIG. 2) via auxiliary outlet line 128 and auxiliary return line 130. The steering/boost system 162 is substantially the same as the above-referenced steering/boost system 62, and consequently the same reference numerals are used to refer to the same or similar structures. In addition, the foregoing description of the steering/boost system 62 is equally applicable to the steering/boost system 162 except as noted below. Moreover, it will be appreciated upon reading and understanding the specification that aspects of the steering/boost systems may be substituted for one another or used in conjunction with one another where applicable.

The steering/boost system 162 includes the electric motor 80, the steering pump 86, the boost pump 88, and a manifold 140. The steering pump 86 supplies hydraulic fluid to one or more hydraulic circuits (not shown) for steering (or other auxiliary function) via line 142. The boost pump 88 supplies hydraulic fluid to the manifold 140 in fluid communication with the communication line 118 for providing boost flow to one or more actuator systems (e.g., 58 and 60 shown in FIG. 2). The steering pump 86 and boost pump 88 may be variable displacement, fixed displacement, or combination of variable and fixed displacement pumps that are mechanically connected to and driven by the electric motor 80.

The manifold 140 includes pressure reducing valve **146*a*, system return and pressure relief valve 146 controlled by a pilot valve 148, and an auxiliary flow priority valve 150 controlled by a pilot valve 152. When steering is demanded and the boost demand is at a maximum, fluid is pumped from the boost pump 88 to the manifold 140 and the auxiliary flow priority valve 150 allows the fluid to flow to the communication line 118 for boost flow to the one or more actuator systems 58 and 60. When steering is demanded and boost demand is minimal, the boost flow is controlled by the control valve 152 to a minimal pressure. When steering is not demanded and boost is demanded, the speed of the electric motor 80** may be varied to satisfy the requisite boost demand.

When full auxiliary function is required, the auxiliary flow priority valve 150 controls the pressure of the fluid to the auxiliary outlet line 128, while allowing sufficient flow to be passed to the boost system through pressure reducing valve **146*a***, which reduces the pressure to boost pressure from the required auxiliary flow pressure.

When partial auxiliary function flow is required and maximum boost flow is required, the auxiliary flow priority valve 150 again controls the pressure at which the auxiliary flow is required based on auxiliary demand, and the priority valve 150 allows up to full boost flow to pass through the valve 150 to the pressure reducing valve 146*a*, where the pressure is then dropped from the auxiliary pressure level to the boost pressure level.

In the illustrated embodiment, the boost circuit is in fluid communication with the auxiliary circuit and the boost pump 88 supplies flow to the auxiliary circuit. More particularly, the boost circuit is selectively in fluid communication with the auxiliary circuit via auxiliary outlet line 128, and the boost pump 88 is sized to satisfy the maximum flow requirement for the boost circuit and to provide additional flow for satisfying at least a portion of the desired flow requirement of the auxiliary circuit. For example, the boost pump 88 may be sized to satisfy the maximum flow requirement of the boost circuit (i.e., provide full boost function) based on the maximum extension speed of the respective actuators 34, 36 and the combined differential volumes between the respective actuators' head-end chambers 94, 96 and the corresponding rod-end chambers 102, 104. Such a configuration enables the boost system 87 to provide full boost power to the one or more actuator systems 58, 60 functions, as well as provide at least some or all of the power required for the auxiliary system 63. This exemplary configuration provides a hydraulic system with simple controls and minimal valving, while enabling reduced interactions and flow disruptions to the actuator functions.

Figure 4:
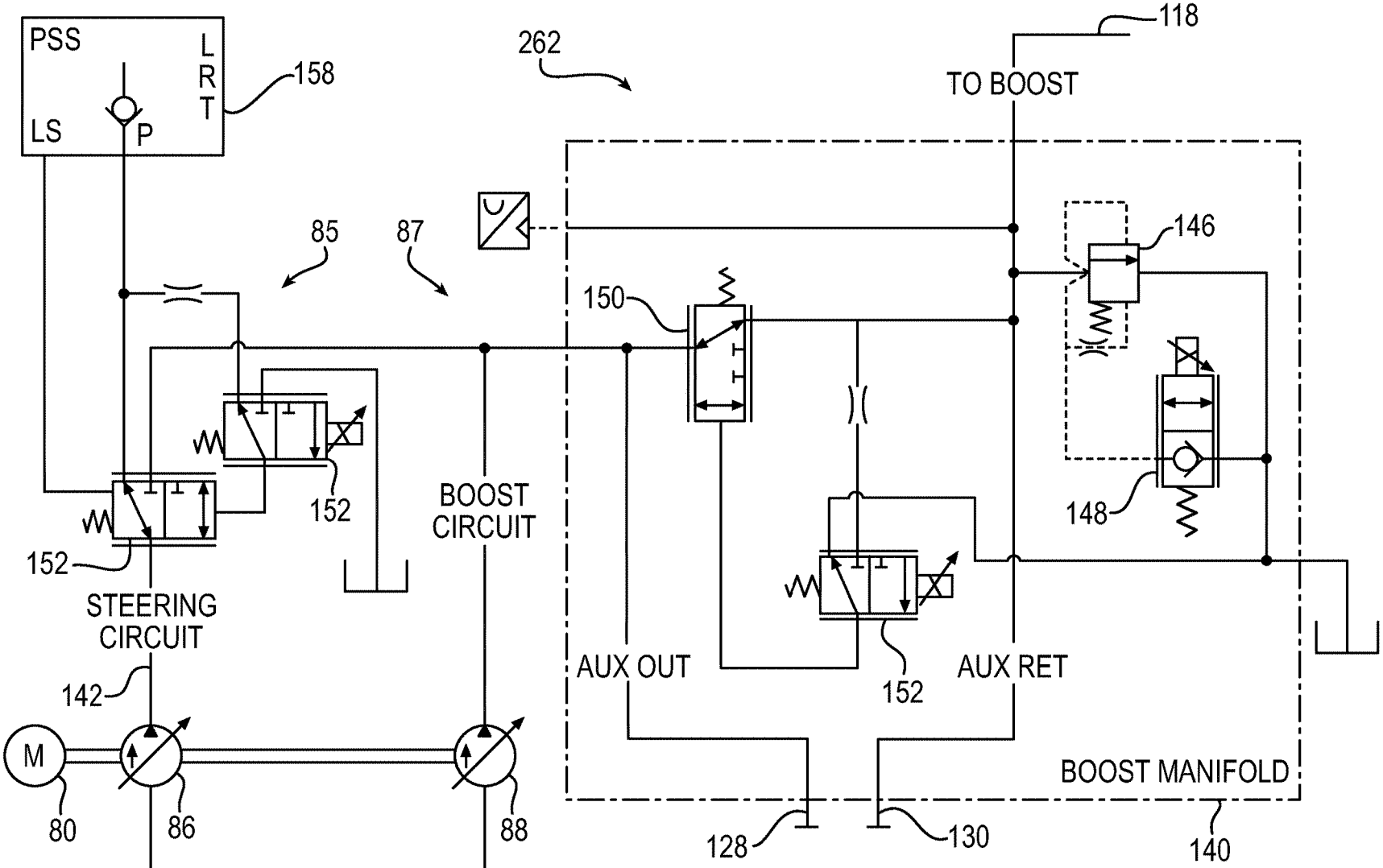
FIG. 4 is a schematic illustration of yet another exemplary hydraulic system according to the invention.

Turning now to FIG. 4, another exemplary embodiment of a portion of the hydraulic system having a steering/boost system 262 is shown. The steering/boost system 262 is similar to the steering/boost system 162, and therefore the same reference numerals are used to refer to the same or similar structures. The steering/boost system 262 includes the steering pump 86 for supplying hydraulic fluid to a steering circuit via line 142. The steering circuit includes steering priority valve 152 and a steering valve 158. Based on the demand created by the steering valve 158, the steering flow is prioritized first to the steering circuit and the remaining flow, if any, is delivered to the boost circuit to be utilized by boost and/or auxiliary function requirements.

In the illustrated embodiment, the steering circuit is selectively in fluid communication with the auxiliary circuit via auxiliary outlet line 128, and the steering pump 86 is sized to satisfy the maximum flow requirement for the steering circuit and to provide additional flow for satisfying at least a portion of the desired flow requirement of the auxiliary circuit. For example, the steering pump 86 may be sized to satisfy the maximum flow requirement of the steering circuit (i.e., provide full steering function) based on the maximum steering demand of the vehicle. Such a configuration enables the steering system 85 to provide full steering function, as well as to provide at least some or all of the power required for the auxiliary system 63.

The boost circuit may also be in fluid communication with both the steering circuit and the auxiliary circuit, which may communicate with the auxiliary outlet line 128 and auxiliary return line 130 via the manifold 140. The flow supplied from the steering system 85 may supplement the flow supplied to the auxiliary system from the boost system 87 so as to satisfy at least a portion of the desired flow requirement of the auxiliary system 63.

In FIG. 4, the manifold 140 includes valving that is the same as or substantially similar to the previous embodiment, except that pressure reducing valve 146*a* is removed and auxiliary return flow from the auxiliary return line 130 is controlled by valves 150 and 152 to the required boost demand pressure to pressurize the boost system at a return pressure sufficient for providing at least a portion of the required boost flow, such that, if sufficient auxiliary flow is demanded, the total boost demand may be provided solely by the auxiliary return flow. The elements of the boost system 87 provided after the auxiliary flow priority valve 150, and fluidly connected to boost supply line 118, may be at a relatively low pressure compared to the operating pressures of the auxiliary system 63.

For example, if the maximum hydraulic pressure and/or flow requirement of the auxiliary system 63 is less than the maximum hydraulic pressure and/or flow requirement of the boost system 87 (i.e., low auxiliary pressure and/or flow), then the boost system 87 and the steering system 85 may each supply pressure and/or flow to satisfy at least a portion of the desired pressure and/or flow requirement of the auxiliary system 63 and the maximum pressure and/or flow requirement of the boost system 87. If the maximum hydraulic pressure and/or flow requirement of the auxiliary system 63 is no less than the maximum hydraulic pressure and/or flow requirement of the boost system 87 (i.e., high auxiliary pressure), and if the boost pressure and/or flow demand is low (i.e., lower than the desired pressure and/or flow requirement of the auxiliary system 63), then return flow from the auxiliary system 63 may be back pressured and returns to the boost system at a slightly elevated return pressure sufficient for providing at least a portion of the maximum pressure and/or flow requirement of the boost system. If the auxiliary pressure and/or flow is low, and the boost pressure and/or flow demand is high (e.g., higher than the auxiliary pressure and/or flow requirement, for example maximum boost pressure and/or flow), then flow from the boost pump 88 is divided such that at least a portion of the flow is provided to the auxiliary system 63 and the remaining maximum pressure and/or flow required by the boost system 87 is delivered through the control valve 150, which drops the auxiliary system 63 pressure to a level no greater than the maximum pressure requirement of the boost system 63. In this manner, the boost system 87 fluidly connected to boost supply line 118 is left to be a relatively low pressure system, while also limiting interactions and reducing flow disruptions to the actuator functions as well.

Figure 5:
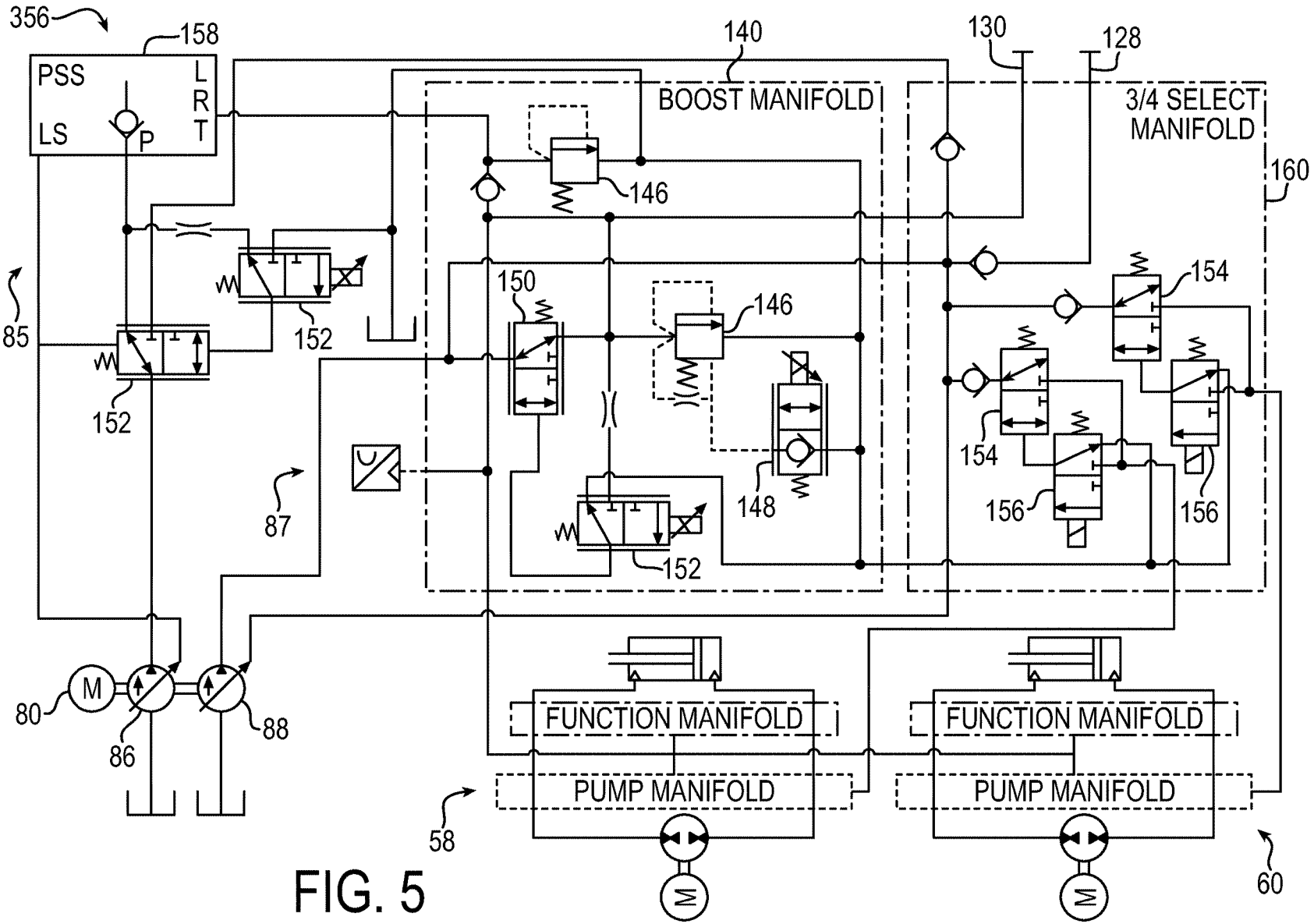
FIG. 5 is a schematic illustration of still another exemplary hydraulic system according to the invention.

Turning to FIG. 5, an exemplary embodiment of another hydraulic system is shown at 356. The hydraulic system 356 includes similar features as described above in connection with the steering/boost system 262, and consequently the same reference numerals are used to refer to the same or similar structures. The hydraulic system 356 includes the steering system 85 having the steering circuit, and the boost system 87 having the boost circuit and the manifold 140. The hydraulic system 356 also includes a select manifold 160 in fluid communication with one or more of the actuator systems 58 and 60, in fluid communication with the steering system 85 and the boost system 87, and in fluid communication with the auxiliary system (e.g., 63 shown in FIG. 2) via auxiliary outlet line 128 and auxiliary return line 130.

In the illustrated embodiment, the select manifold 160 of the hydraulic system 356 is operable to selectively choose flow from one or more of the actuator systems 58 and 60 via selector valves 154 and control valves 156. Based on the absence of actuator flow demands during operation, the respective selector valves 154 will be opened based on system operation via the electrically controlled pilot valves 156, and the corresponding actuator system 58, 60 will operate to provide sufficient flow and pressure to the auxiliary supply line 128.

In this regard, the hydraulic system 356 is an exemplary illustration of a hydraulic system that is controllable to selectively supply flow to the auxiliary system 63 from at least one of the steering system 85, the boost system 87, and one or more of the actuator systems 58, 60 based on the flow and pressure demands of the respective hydraulic systems 58, 60, 85, and 87. For example, if at least one of the actuator systems 58 and 60 is available (i.e., no actuator demand is present), then the at least one available actuator system 58, 60 may supply flow to the auxiliary system 63 to satisfy at least a portion of the desired flow requirement of the auxiliary system 63. If none of the actuator systems 58 and 60 are available (i.e., both actuators are simultaneously demanded), then flow from the boost system 87 and/or the steering system 85 may supply flow to the auxiliary system 63 to satisfy at least a portion of the desired flow requirement of the auxiliary system 63. In addition, where at least one of the actuator system 58 and 60 is available, but does not satisfy the desired flow requirement of the auxiliary system 63, then available flow from at least one of the boost system 87 and the steering system 85 may supplement at least a portion of the desired flow requirement of the auxiliary system 63. Such a configuration of the hydraulic system 356 enables prioritization of the source of auxiliary flow to provide minimal power loss due to metering, and also allows at least one of the actuator systems 58 and 60 to remain isolated, since only the unused actuator system 58 and/or 60 would supply at least some of the auxiliary flow.

Figure 6:
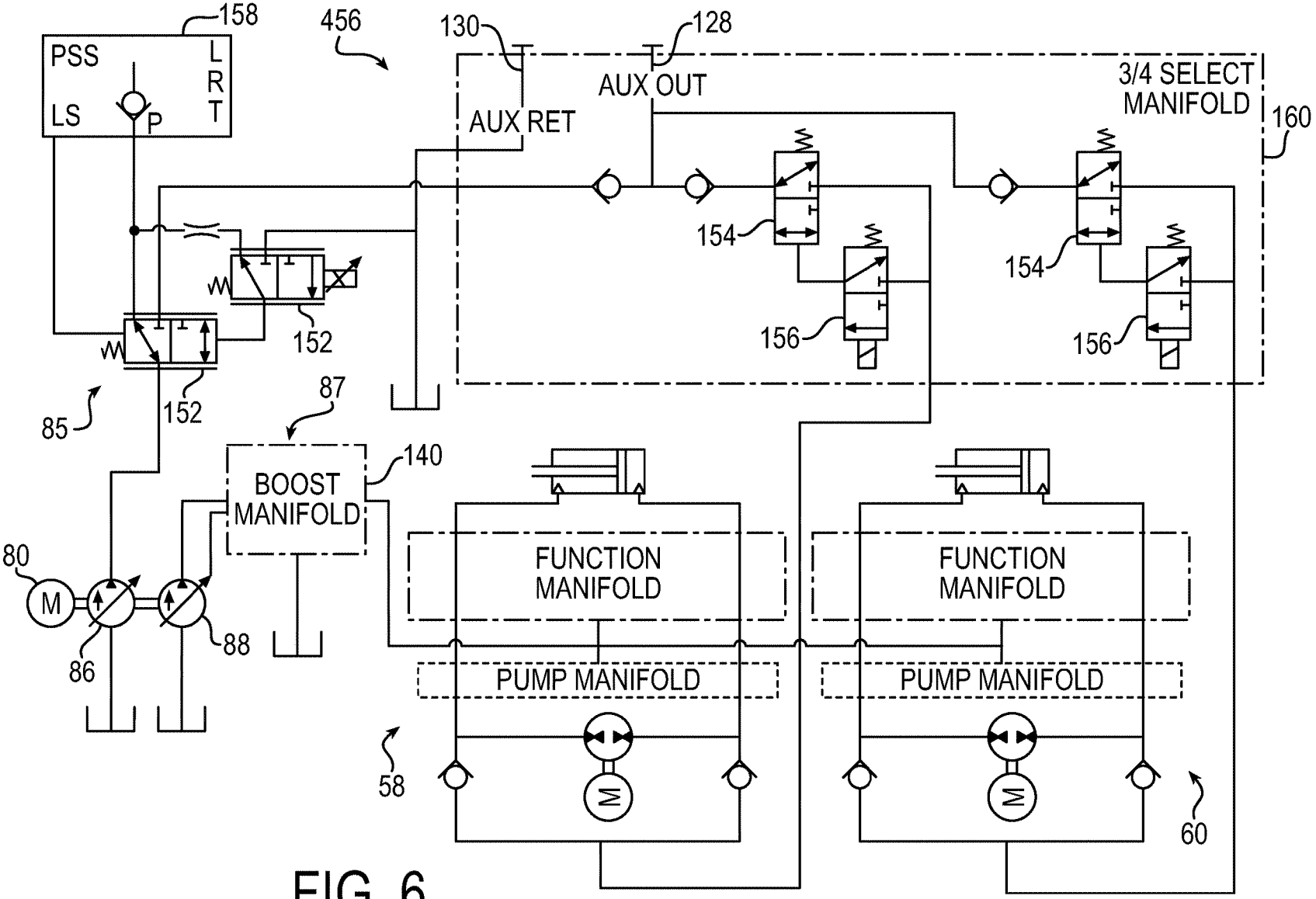
FIG. 6 is a schematic illustration of a further exemplary hydraulic system according to the invention.

Turning now to FIG. 6, another exemplary embodiment of a hydraulic system is shown at 456. The hydraulic system 456 includes similar features as described above in connection with the hydraulic system 356, and consequently the same reference numerals are used to refer to the same or similar structures. The hydraulic system 456 includes the steering system 85 having the steering circuit, and the boost system 87 having the boost circuit and the manifold 140. The hydraulic system 356 also includes the select manifold 160 in fluid communication with one or more of the actuator systems 58 and 60, in fluid communication with the steering system 85, and in fluid communication with the auxiliary system (e.g., 63 shown in FIG. 2) via auxiliary outlet line 128 and auxiliary return line 130. In the exemplary embodiment, the boost system 87 is in fluid communication with one or more of the actuator systems 58 and 60, but is not in fluid communication with the select manifold 160.

In the illustrated embodiment, the select manifold 160 of the hydraulic system 456 is operable to selectively allow flow via selector valves 154 operated by electrically controlled pilot valves 156. Based on the absence or lack of actuator flow demands during operation, the respective selector valves 154 will be opened based on system operation via the electrically controlled pilot valves 156, and the corresponding actuator system 58, 60 will operate to provide sufficient flow and pressure to the auxiliary supply line 128. Check valves are supplied in the hydraulic circuitry of the actuator systems 58, 60 such that one or both of the actuator systems 58 and 60 may supply available flow to the auxiliary circuit to satisfy at least a portion of the desired flow requirement of the auxiliary circuit.

The hydraulic system 456 is another exemplary illustration of a hydraulic system that is controllable to selectively supply flow to the auxiliary system 63 from the steering system 85 and/or at least one of the actuator systems 58, 60 based on the flow and pressure demands of the respective hydraulic systems 58, 60, 85. For example, if an unused portion of flow from the actuator systems 58 and/or 60 is available, then the actuator systems 58 and/or 60 may supply flow to the auxiliary system to satisfy at least a portion of the desired flow requirement of the auxiliary system. If unused flow from the actuator systems 58 and/or 60 is unavailable, then available flow from the steering system 85 is selected to supply flow to the auxiliary system 63 to satisfy at least a portion of the desired flow requirement of the auxiliary system 63. Where available flow from the actuator systems 58 and/or 60 does not satisfy all or most of the desired flow requirement of the auxiliary system 63, then available flow from the steering system 85 may supplement at least a portion of the desired flow requirement of the auxiliary system 63. In some embodiments, if unused flow from the actuator systems 58 and/or 60 is unavailable, or does not satisfy the desired flow requirement of the auxiliary system 63, then flow from the boost system 87 may also be used to satisfy or supplement at least a portion of the desired flow requirement of the auxiliary system 63. This enables the hydraulic system 456 to minimize interaction between the auxiliary functions and actuator functions, and also reduces the need for additional installed power, such as oversized hydraulic pumps.

Although the invention has been shown and described with respect to a certain embodiment or embodiments, it is obvious that equivalent alterations and modifications will occur to others skilled in the art upon the reading and understanding of this specification and the annexed drawings. For example, although the hydraulic system shown and described above includes two actuator systems having unbalanced cylinders, there could be only one actuator system, or more than two actuator systems, including various hydraulically actuated functions other than operating an unbalanced cylinder. In addition, more than one boost system may be provided, and the boost system may or may not be in fluid communication with the steering system and/or auxiliary system. Furthermore, the additional hydraulic system, including but not limited to the steering system described above, may or may not be in fluid communication with the boost system or the auxiliary system. There may be one or more additional or secondary hydraulic systems provided in the hydraulic system, or the secondary hydraulic system may not be part of the hydraulic system that includes the auxiliary system, and may be provided in a separate and distinct hydraulic system. In addition, pumps used for actuator functions, steering functions, and/or boost functions (e.g., 82, 84, 86, 88) are shown and discussed as fixed and variable, but could be all fixed or a different combination of fixed and variable. The pumps may be "oversized" to satisfy their respective maximum desired flow requirements and supply additional flow for satisfying other functions, such as the desired flow requirement for the auxiliary function.

In addition, with respect to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic system for a vehicle comprising:

at least one actuator system that supplies hydraulic fluid to control all of a set of primary hydraulically actuated functions, the at least one actuator system having a maximum flow requirement for the set of primary hydraulically actuated functions;

a boost system having a maximum flow requirement for supplying or accepting hydraulic fluid to or from the at least one actuator system;

an additional system that supplies hydraulic fluid to control an additional primary hydraulically actuated function, the additional system having a maximum flow requirement for the additional primary hydraulically actuated function; and an auxiliary system having an auxiliary outlet port for removable connection of an auxiliary implement comprising a detachable tool, the auxiliary system being configured to supply hydraulic fluid via the auxiliary outlet port to control an auxiliary hydraulic function of the auxiliary implement, the auxiliary system having a desired flow requirement for operating the auxiliary implement;

wherein at least one of the boost system, the additional system, and the at least one actuator system is selectively in fluid communication with the auxiliary system for supplying hydraulic fluid to the auxiliary implement via the auxiliary outlet port when the auxiliary implement is fluidly connected to the vehicle via the auxiliary outlet port;

wherein at least one of the boost system, the additional system, and the at least one actuator system includes an additional source of flow for satisfying at least a portion of the desired flow requirement of the auxiliary system for operating the auxiliary implement when the auxiliary implement is fluidly connected to the vehicle via the auxiliary outlet port; and wherein all of the set of primary hydraulically actuated functions and the additional primary hydraulic function are fully operable when the auxiliary implement is disconnected from the auxiliary system.

2. The hydraulic system according to claim 1, wherein the at least one actuator system includes a primary hydraulic pump for satisfying the maximum flow requirement of the at least one actuator system; and wherein at least one of the boost system and the additional system includes at least one hydraulic pump that collectively or singly satisfies the respective maximum flow requirements of the boost system, the additional system, and/or at least some of the desired flow for the auxiliary system.

3. The hydraulic system according to claim 2, wherein the at least one actuator system includes an unbalanced actuator having an extend chamber and a retract chamber to and from which hydraulic fluid is supplied and returned in opposite directions to effect operation of at least one primary function of the set of primary hydraulically actuated functions;

wherein the primary hydraulic pump is a bi-directional pump operable in one direction for supplying hydraulic fluid through a first fluid flow line to the extend chamber of the unbalanced actuator, and operable in another direction for supplying hydraulic fluid through a second fluid flow line to the retract chamber of the unbalanced actuator; and wherein the boost system includes a boost pump for supplying hydraulic fluid to a fluid communication line selectively in fluid communication with one of the first or second fluid flow lines.

4. The hydraulic system according to claim 3, wherein the boost system is selectively in fluid communication with the auxiliary system, and wherein the additional source of flow includes the boost pump that is sized to satisfy the maximum flow requirement for the boost system and additional flow for satisfying at least a portion of the desired flow requirement of the auxiliary system.

5. The hydraulic system according to claim 1, wherein the additional system is a steering system, the steering system including a steering pump for supplying hydraulic fluid to a steering circuit to satisfy the maximum flow requirement for a hydraulically actuated steering function as the additional primary hydraulically actuated function; and wherein the boost system includes a boost pump for supplying hydraulic fluid to a boost circuit to satisfy the maximum flow requirement for accepting or supplying hydraulic fluid from or to the at least one actuator system.

6. The hydraulic system according to claim 5, wherein the at least one actuator system includes a primary hydraulic pump for satisfying the maximum flow requirement of the at least one actuator system;

the hydraulic system further comprising:

an electric motor for driving the primary hydraulic pump; and a single electric motor for driving both the boost pump and the steering pump.

7. The hydraulic system according to claim 5, wherein the steering system is selectively in fluid communication with the auxiliary system, and wherein the additional source of flow includes the steering pump that is sized to satisfy the maximum flow requirement for the steering system and additional flow for satisfying at least a portion of the desired flow requirement of the auxiliary system.

8. The hydraulic system according to claim 7, wherein the boost system is in fluid communication with the steering system and the auxiliary system;

wherein the boost system includes the boost pump that provides flow to the auxiliary system for satisfying at least a portion of the desired flow requirement of the auxiliary system; and wherein the steering system provides flow to the auxiliary system to supplement at least a portion of the flow provided to the auxiliary system by the boost system.

9. The hydraulic system according to claim 7, wherein the boost system supplies hydraulic fluid to the auxiliary system through an auxiliary outlet line, and wherein hydraulic fluid is returned from the auxiliary system to the boost system through an auxiliary return line at a return pressure sufficient for providing at least a portion of the maximum flow requirement of the boost system.

10. The hydraulic system according to claim 9, wherein the boost system is in fluid communication with the steering system and the auxiliary system;

wherein the boost system and the auxiliary system each have a maximum hydraulic pressure and/or flow requirement; and wherein, if the maximum hydraulic pressure and/or flow requirement of the auxiliary system is less than the maximum hydraulic pressure and/or flow requirement of the boost system, then the boost system and the steering system each supply pressure and/or flow to satisfy at least a portion of the desired pressure and/or flow requirement of the auxiliary system and the maximum pressure and/or flow requirement of the boost system.

11. The hydraulic system according to claim 1, wherein the boost system and the auxiliary system each have a maximum hydraulic pressure and/or flow requirement;

wherein, if the maximum hydraulic pressure and/or flow requirement of the auxiliary system is no less than the maximum hydraulic pressure and/or flow requirement of the boost system, then return pressure and/or flow from the auxiliary system returns to the boost system at a return pressure sufficient for providing at least a portion of the maximum flow requirement and/or maximum pressure requirement of the boost system; and wherein, if the maximum hydraulic pressure and/or flow requirement of the auxiliary system is less than the maximum hydraulic pressure and/or flow requirement of the boost system, then flow from a boost pump is divided such that at least a portion of the flow from the boost pump is provided to the auxiliary system and the remaining flow is delivered through a control valve to the boost system.

12. The hydraulic system according to claim 1, wherein the at least one actuator system is selectively in fluid communication with the auxiliary system, and at least one of the boost system and the additional system is selectively in fluid communication with the auxiliary system;

wherein, if an unused portion of flow from the at least one actuator system is available, then the additional source of flow for satisfying at least a portion of the desired flow requirement of the auxiliary system includes the unused portion of available flow from the at least one actuator system; and wherein, if an unused portion of flow from the at least one actuator system is unavailable, then the additional source of flow for satisfying at least a portion of the desired flow requirement for the auxiliary system includes available flow from at least one of the boost system and the additional system; and wherein, if the unused portion of available flow from the at least one actuator system does not satisfy the desired flow requirement of the auxiliary system, then available flow from at least one of the boost system and the additional system supplements at least a portion of the desired flow requirement of the auxiliary system.

13. The hydraulic system according to claim 1, wherein the at least one actuator system includes two actuator systems for operation of respective primary functions of the set of primary hydraulically actuated functions, the respective actuator systems each including a hydraulic pump for satisfying the maximum flow requirements of the respective actuator systems;

wherein the respective actuator systems are selectively in fluid communication with the auxiliary system, and the additional system is selectively in fluid communication with the auxiliary system;

wherein the additional source of flow includes unused portions of available flow from the respective actuator systems for satisfying at least a portion of the desired flow requirement of the auxiliary system; and wherein, if unused portions of flow from the respective actuator systems is unavailable, then the additional source of flow for satisfying at least a portion of the desired flow requirement for the auxiliary system includes available flow from the additional system.

14. The hydraulic system according to claim 13, wherein the additional system is a steering system having a steering pump for supplying hydraulic fluid to a steering circuit to satisfy the maximum flow requirement for a hydraulically actuated steering function as the additionally primary hydraulically actuated function; and wherein, if the unused portions of available flow from the respective actuator systems does not satisfy the desired flow requirement of the auxiliary system, then available flow from the steering system supplements at least a portion of the desired flow requirement of the auxiliary system.

15. The hydraulic system according to claim 1, wherein the at least one actuator system includes a hydraulic pump for satisfying the maximum flow requirement of the at least one actuator system;

wherein the at least one actuator system is selectively in fluid communication with the auxiliary system, and at least one of the boost system and the additional system is selectively in fluid communication with the auxiliary system;

wherein, if the at least one actuator system does not demand flow for effecting control of at least one primary function of the set of primary hydraulically actuated functions, then the additional source of flow for satisfying at least a portion of the desired flow requirement of the auxiliary system includes flow from the at least one actuator system that does not demand flow; and wherein, if the at least one actuator system demands flow for effecting control of at least one primary function of the set of primary hydraulically actuated functions, then the at least one actuator system demanding flow is selectively closed from supplying flow to the auxiliary system, and the additional source of flow for satisfying at least a portion of the desired flow requirement of the auxiliary system includes available flow from at least one of the boost system and the additional system.

16. The hydraulic system according to claim 15, wherein the additional system is a steering system having a steering pump for supplying hydraulic fluid to a steering circuit to satisfy the maximum flow requirement for a hydraulically actuated steering function as the additional primary hydraulically actuated function; and wherein, if the available flow from the at least one actuator system that supplies flow to the auxiliary system does not satisfy the desired flow requirement of the auxiliary system, then available flow from at least one of the steering system and the boost system supplements at least a portion of the desired flow requirement of the auxiliary system.

17. The hydraulic system according to claim 1, wherein the at least one actuator system includes two actuator systems for operation of respective primary functions of the set of primary hydraulically actuated functions, the respective actuator systems each including a hydraulic pump for satisfying the maximum flow requirements of the respective actuator systems;

wherein the respective actuator systems are selectively in fluid communication with the auxiliary system, and at least one of the boost system and the additional system is selectively in fluid communication with the auxiliary system;

wherein, if at least one of the respective actuator systems does not demand flow for effecting control of at least one of the primary functions of the set of primary hydraulically actuated functions, then the additional source of flow for satisfying at least a portion of the desired flow requirement of the auxiliary system includes flow from the at least one actuator system that does not demand flow; and wherein, if at least one of the respective actuator systems demands flow for effecting control of at least one of the primary functions of the set of primary hydraulically actuated functions, then the at least one actuator system demanding flow is selectively closed from supplying flow to the auxiliary system, and the additional source of flow for satisfying at least a portion of the desired flow requirement of the auxiliary system includes available flow from at least one of the boost system, the additional system, and another actuator system that does not demand flow.

18. The hydraulic system according to claim 1, wherein the at least one actuator system includes:

an unbalanced actuator having an extend chamber and a retract chamber to and from which hydraulic fluid is supplied and returned in opposite directions to effect operation of the hydraulically operated function; and a bi-directional pump operable in one direction for supplying hydraulic fluid through a first fluid flow line to the extend chamber of the unbalanced actuator, and operable in another direction for supplying hydraulic fluid through a second fluid flow line to the retract chamber of the unbalanced actuator;

wherein the additional system is a steering circuit including a steering pump, the steering pump for supplying hydraulic fluid to the steering circuit for a hydraulically actuated steering function as the additionally primary hydraulically actuated function; and wherein the boost system includes a boost pump for supplying hydraulic fluid to the boost system connected to a fluid communication line selectively in fluid communication with one of the first or second fluid flow lines of the at least one actuator system; and wherein, if an unused portion of flow from the at least one actuator system is available, the at least one actuator system supplies flow to the auxiliary system to satisfy at least a portion of the desired flow requirement of the auxiliary system; and wherein, if an unused portion of flow from the at least one actuator system is unavailable, then flow from at least one of the boost circuit and the additional hydraulic circuit supplies flow to the auxiliary system to satisfy at least a portion of the desired flow requirement of the auxiliary system.

19. The hydraulic system according to claim 1, wherein the set of primary hydraulically actuated functions of the at least one actuator system includes one or more actuators that are configured to fully operate a boom, an arm, a bucket, or a swing of the vehicle.

20. The hydraulic system according to claim 19, wherein the vehicle includes main hydraulic functions that are required to operate the vehicle according to its intended purpose, wherein the set of primary hydraulically actuated functions of the boom, the arm, the bucket or the swing, and the additional hydraulically actuated function, constitute at least some of the main hydraulic functions of the vehicle, and wherein all of the main hydraulic functions of the vehicle are fully operable when the auxiliary implement is disconnected from the auxiliary system.

21. A hydraulic system for a vehicle comprising:

a plurality of primary hydraulic circuits that supply hydraulic fluid to control all of a set of primary hydraulically actuated functions of the vehicle;

a boost pump for supplying hydraulic fluid to a boost circuit in fluid communication with at least one of the plurality of primary hydraulic circuits; and an auxiliary circuit having an auxiliary outlet port for removable connection of an auxiliary implement comprising a detachable tool, the auxiliary circuit being configured to supply hydraulic fluid via the auxiliary outlet port to control an auxiliary hydraulic function of the auxiliary implement, the auxiliary system having a desired flow requirement for operating the auxiliary implement;

wherein the boost circuit is in fluid communication with the auxiliary circuit and the boost pump supplies flow to the auxiliary circuit to satisfy at least a portion of the desired flow requirement of the auxiliary circuit for operating the auxiliary implement when the auxiliary implement is fluidly connected to the vehicle via the auxiliary outlet port;

wherein the boost circuit includes a boost manifold in fluid communication with the at least one of the plurality of hydraulic circuits and the auxiliary circuit;

wherein the boost manifold includes an auxiliary flow priority valve controlled by a pilot valve; and wherein all of the set of primary hydraulically actuated functions is fully operable when the auxiliary implement is disconnected from the auxiliary circuit.

22. The hydraulic system according to claim 21, wherein the auxiliary flow priority valve is configured to control the hydraulic fluid pressure supplied to the auxiliary circuit, and auxiliary return flow is utilized by the boost circuit to satisfy the maximum required boost flow.

23. The hydraulic system according to claim 21, wherein the boost manifold further includes a pressure reducing valve; and wherein, if the auxiliary flow demand is minimal and if the boost flow demand is about maximum, then the auxiliary flow priority valve is configured to allow up to the maximum boost flow to pass through the auxiliary flow priority valve to the pressure reducing valve, where the pressure from the auxiliary circuit is reduced to a level about equal to the pressure requirement of the boost circuit.

24. A hydraulic system for a vehicle comprising:

at least one first primary hydraulic circuit that supplies hydraulic fluid to control all of a set of first primary functions, the at least one first primary hydraulic circuit having a maximum flow requirement for use in effecting the set of first primary functions;

a boost circuit for supplying or accepting hydraulic fluid to or from the first primary hydraulic circuit;

an additional hydraulic circuit that supplies hydraulic fluid to control an additional primary function; and an auxiliary circuit having an auxiliary outlet port for removable connection of an auxiliary implement comprising a detachable tool, the auxiliary system being configured to supply hydraulic fluid via the auxiliary outlet port to control an auxiliary function of the auxiliary implement, the auxiliary system having a desired flow requirement for the auxiliary function;

wherein the at least one first primary hydraulic circuit and at least one of the boost circuit and the additional hydraulic circuit are selectively in fluid communication with the auxiliary circuit;

the hydraulic system further comprising a select manifold in fluid communication with the at least one first primary hydraulic circuit, in fluid communication with the additional hydraulic circuit, and in fluid communication with the auxiliary circuit;

wherein the select manifold includes a selector valve operated by an electrically controlled pilot valve, the selector valve being configured to selectively allow flow to be supplied from the at least one first primary hydraulic circuit to the auxiliary circuit based on the flow demands of the at least one first primary hydraulic circuit; and wherein all of the set of the first primary functions and the additional primary function are fully operable when the auxiliary implement is disconnected from the auxiliary system.

* * * * *